US009220315B2

(12) United States Patent
Lupinek et al.

(10) Patent No.: US 9,220,315 B2
(45) Date of Patent: Dec. 29, 2015

(54) ARTICLE OF FOOTWEAR WITH AN INDICATOR FOR A HEATING SYSTEM

(75) Inventors: Jaroslav J. Lupinek, Portland, OR (US); Patricia L. Smaldone, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 510 days.

(21) Appl. No.: 13/597,874

(22) Filed: Aug. 29, 2012

(65) Prior Publication Data

US 2014/0059894 A1 Mar. 6, 2014

(51) Int. Cl.

| | |
|---|---|
| ***A43B 7/02*** | (2006.01) |
| ***A43B 7/34*** | (2006.01) |
| ***A43B 1/00*** | (2006.01) |
| ***A43B 3/00*** | (2006.01) |
| ***A43B 5/04*** | (2006.01) |
| ***A43B 7/04*** | (2006.01) |

(52) U.S. Cl.

CPC ..... *A43B 7/34* (2013.01); *A43B 1/0072* (2013.01); *A43B 3/001* (2013.01); *A43B 3/0015* (2013.01); *A43B 5/0405* (2013.01); *A43B 7/02* (2013.01); *A43B 7/04* (2013.01)

(58) Field of Classification Search

CPC ..... A43B 7/34; A43B 3/0005; A43B 3/001; A43B 5/004; A43B 5/0405; A43B 7/02; A43B 5/0409; A43B 3/0015; A61F 2007/0045; A61F 2007/0046

USPC ..... 36/137, 114, 117.1, 2.6, 55

See application file for complete search history.

(56) References Cited

U.S. PATENT DOCUMENTS

| | | | |
|---|---|---|---|
| 73,010 | A | 1/1868 | Holland |
| 1,702,583 | A | 2/1929 | Williams |
| 3,392,264 | A | 7/1968 | Arron |
| 3,663,796 | A | 5/1972 | Hines et al. |
| 3,859,496 | A | 1/1975 | Giese |
| 3,935,856 | A | 2/1976 | Loftin |
| 4,023,282 | A | 5/1977 | Ziegelheafer |

(Continued)

FOREIGN PATENT DOCUMENTS

| | | |
|---|---|---|
| CN | 2862760 | 1/2007 |
| CN | 201523713 | 7/2010 |

(Continued)

OTHER PUBLICATIONS

Kalinich, Sean, "Selling Bugathermo Rechargable, Heated Boots," Oct. 14, 2009, http://www.brightsideofnews.com/2009/10/14/columbia-footwear-now-selling-bugathermo-rechargable2c-heated2c-boots/.*

(Continued)

*Primary Examiner* — Jila M Mohandesi
*Assistant Examiner* — Carolyn W Davis
(74) *Attorney, Agent, or Firm* — Plumes Law Group, LLC

(57) ABSTRACT

An indicator for a heated article of footwear that includes an outer shell and a removable inner liner is described. The inner liner includes a heating system with an indicator disposed on a forefoot region of the inner liner. The heating system is integrated within the inner liner and is removable with the inner liner from the outer shell. A viewing window is disposed on the outer shell at a location corresponding to the indicator located on the inner liner. With this arrangement, the status condition of the heating system on the inner liner may be communicated to a wearer of the article through the viewing window from within the interior of the article.

19 Claims, 11 Drawing Sheets

(56) References Cited

U.S. PATENT DOCUMENTS

| | | | | |
|---|---|---|---|---|
| 4,094,080 | A | 6/1978 | Sanders | |
| 4,507,877 | A | 4/1985 | Vaccari et al. | |
| 4,523,392 | A | 6/1985 | Gabrielli | |
| 4,651,446 | A | 3/1987 | Yukawa | |
| 4,665,308 | A | 5/1987 | Courvoisier et al. | |
| 4,697,363 | A | 10/1987 | Gamm | |
| 4,705,935 | A | 11/1987 | Traffanstedt et al. | |
| 4,862,603 | A | 9/1989 | Balbinot | |
| 4,894,931 | A | 1/1990 | Senee et al. | |
| 4,910,881 | A | 3/1990 | Baggio et al. | |
| 5,062,222 | A * | 11/1991 | Billet et al. | 36/2.6 |
| 5,063,690 | A | 11/1991 | Slenker | |
| 5,105,067 | A | 4/1992 | Brekkestran et al. | |
| 5,140,131 | A | 8/1992 | Macher et al. | |
| 5,500,635 | A | 3/1996 | Mott | |
| 5,623,772 | A * | 4/1997 | Sunderland et al. | 36/2.6 |
| 5,640,786 | A | 6/1997 | Buyayez | |
| 5,746,016 | A * | 5/1998 | Freisinger et al. | 36/117.1 |
| 5,829,171 | A | 11/1998 | Weber et al. | |
| 5,894,686 | A | 4/1999 | Parker et al. | |
| 6,003,248 | A | 12/1999 | Hilgarth | |
| 6,657,164 | B1 | 12/2003 | Koch | |
| 6,776,498 | B2 | 8/2004 | Yeung | |
| 6,841,757 | B2 | 1/2005 | Marega et al. | |
| 6,993,858 | B2 * | 2/2006 | Seamans | 36/3 A |
| 7,186,957 | B2 | 3/2007 | Martin | |
| 7,202,443 | B2 | 4/2007 | Rock et al. | |
| 7,268,320 | B2 | 9/2007 | Rock et al. | |
| 7,421,806 | B2 * | 9/2008 | Braynock et al. | 36/100 |
| 7,631,382 | B2 | 12/2009 | DiBenedetto et al. | |
| 7,841,107 | B2 | 11/2010 | Braynock et al. | |
| 8,087,186 | B2 | 1/2012 | Rastegar et al. | |
| 2004/0020074 | A1 | 2/2004 | Brait et al. | |
| 2004/0025373 | A1 * | 2/2004 | Schuver et al. | 36/8.4 |
| 2004/0244221 | A1 * | 12/2004 | Hall et al. | 36/10 |
| 2005/0167412 | A1 | 8/2005 | Anson et al. | |
| 2005/0223602 | A1 * | 10/2005 | Cagliari | 36/136 |
| 2006/0096129 | A1 * | 5/2006 | Kaplan et al. | 36/112 |
| 2006/0112599 | A1 * | 6/2006 | Braynock et al. | 36/137 |
| 2006/0201025 | A1 | 9/2006 | Chou | |
| 2006/0248747 | A1 | 11/2006 | Reid | |
| 2007/0039201 | A1 | 2/2007 | Axinte | |
| 2007/0089318 | A1 | 4/2007 | Ferguson | |
| 2009/0013554 | A1 | 1/2009 | Macher et al. | |
| 2009/0032520 | A1 | 2/2009 | Cronn | |
| 2009/0288317 | A1 * | 11/2009 | Forbes | 36/136 |
| 2010/0212183 | A1 * | 8/2010 | Seliger et al. | 36/2.6 |
| 2010/0328088 | A1 | 12/2010 | Lin et al. | |
| 2011/0083339 | A1 | 4/2011 | Luo | |
| 2011/0107771 | A1 | 5/2011 | Crist et al. | |
| 2011/0225849 | A1 | 9/2011 | Zubyk | |
| 2011/0239488 | A1 | 10/2011 | Carnes et al. | |
| 2011/0308113 | A1 | 12/2011 | Hartford et al. | |
| 2012/0018418 | A1 | 1/2012 | Shantha et al. | |
| 2012/0188750 | A1 * | 7/2012 | Marston | 362/103 |
| 2014/0059882 | A1 | 3/2014 | Lupinek et al. | |

FOREIGN PATENT DOCUMENTS

| | | |
|---|---|---|
| CN | 201813956 | 5/2011 |
| CN | 201869866 | 6/2011 |
| DE | 102010055761 | 6/2012 |
| EP | 1872931 | 1/2008 |

OTHER PUBLICATIONS

ZapposGear, "Columbia Bugathermo™ 7658139," Nov. 10, 2010, https://www.youtube.com/watch?v=fZZEtJY8kyM.*

International Search Report and Written Opinion mailed Dec. 18, 2013 in International Application No. PCT/US2013/056933.

International Search Report and Written Opinion mailed Dec. 18, 2013 in International Application No. PCT/US2013/056936.

Office Action mailed Dec. 16, 2014 in U.S. Appl. No. 13/597,506.

International Preliminary Report on Patentability (including Written Opinion of the ISA) mailed Mar. 12, 2015 in International Application No. PCT/US2013/056933.

International Preliminary Report on Patentability (including Written Opinion of the ISA) mailed Mar. 12, 2015 in International Application No. PCT/US2013/056936.

* cited by examiner

ARTICLE OF FOOTWEAR WITH AN INDICATOR FOR A HEATING SYSTEM

BACKGROUND

The present invention relates generally to an article of footwear, and more specifically, to an article of footwear with an indicator for a heating system.

Indicator lights or LEDs to indicate the status of heating elements have been previously proposed. U.S. Pat. No. 5,623,772 to Sunderland discloses a foot warming system for a boot that includes a battery pack on the outside of a boot that has LEDs to indicate the setting of a heating element. U.S. patent application publication number 2012/0018418 to Shantha et al. discloses temperature controllable shoes with an indicator light assembly disposed along a heel of the shoe.

Previously proposed designs, however, may require additional connections or wiring to place the indicator lights or LEDs in a place where they may be visible or may not place the indicator lights or LEDs in a location that is easily and readily visible to a wearer of an article of footwear.

Therefore, there exists a need in the art for an indicator for a heating system that is visible from the interior of an article of footwear.

SUMMARY

In one aspect, the invention provides an article of footwear comprising: an outer shell, the outer shell including an upper and a sole structure; an inner liner, the inner liner being configured to be removably inserted within an interior of the outer shell; the inner liner further comprising a heating system, the heating system including a power source and at least one heating element; the inner liner having an upper liner portion and a lower liner portion, wherein the lower liner portion includes an indicator disposed along a top of a forefoot region of the inner liner; wherein the indicator is in communication with the heating system, the indicator being configured to indicate a status condition of the heating system; and wherein outer shell further comprises a viewing window disposed on a top portion of the upper, the viewing window being substantially aligned over the indicator disposed on the inner liner.

In another aspect, the invention provides an article of footwear comprising: an outer shell, the outer shell including an upper and a sole structure; an inner liner, the inner liner being configured to be removably inserted within an interior of the outer shell; the inner liner further comprising a heating system, the heating system including a power source, a control mechanism, and at least one heating element; the inner liner having an upper liner portion and a lower liner portion; the lower liner portion including a bottom disposed along an underside of the inner liner, the bottom being configured to rest along a bottom of the interior of the outer shell when the inner liner is inserted within the outer shell; the lower liner further comprising a top forefoot portion disposed along a top of the inner liner in a forefoot region and an indicator disposed on the top forefoot portion; wherein the indicator is connected to the heating system; and wherein the indicator is visible from within the interior of the outer shell through a viewing window disposed on a top portion of the upper in the forefoot region of the outer shell.

In another aspect, the invention provides an article of footwear comprising: an outer shell and an inner liner, the inner liner including an integrated heating system; the inner liner being configured to be removably inserted within an interior of the outer shell; the integrated heating system including a control mechanism, a power source, and a heating element; the inner liner having an upper liner portion and a lower liner portion, wherein the lower liner portion includes an indicator disposed along a top of a forefoot region of the inner liner; wherein the indicator is connected to at least one of the control mechanism and the heating element, the indicator being configured to indicate a status condition of the heating system; wherein the indicator is configured to be in a non-illuminated condition when the heating system is in a first state and wherein the indicator is configured to be in an illuminated condition when heating system is in a second state; and wherein outer shell further comprises a viewing window disposed on a top portion of an upper, the viewing window being substantially aligned over the indicator disposed on the inner liner.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
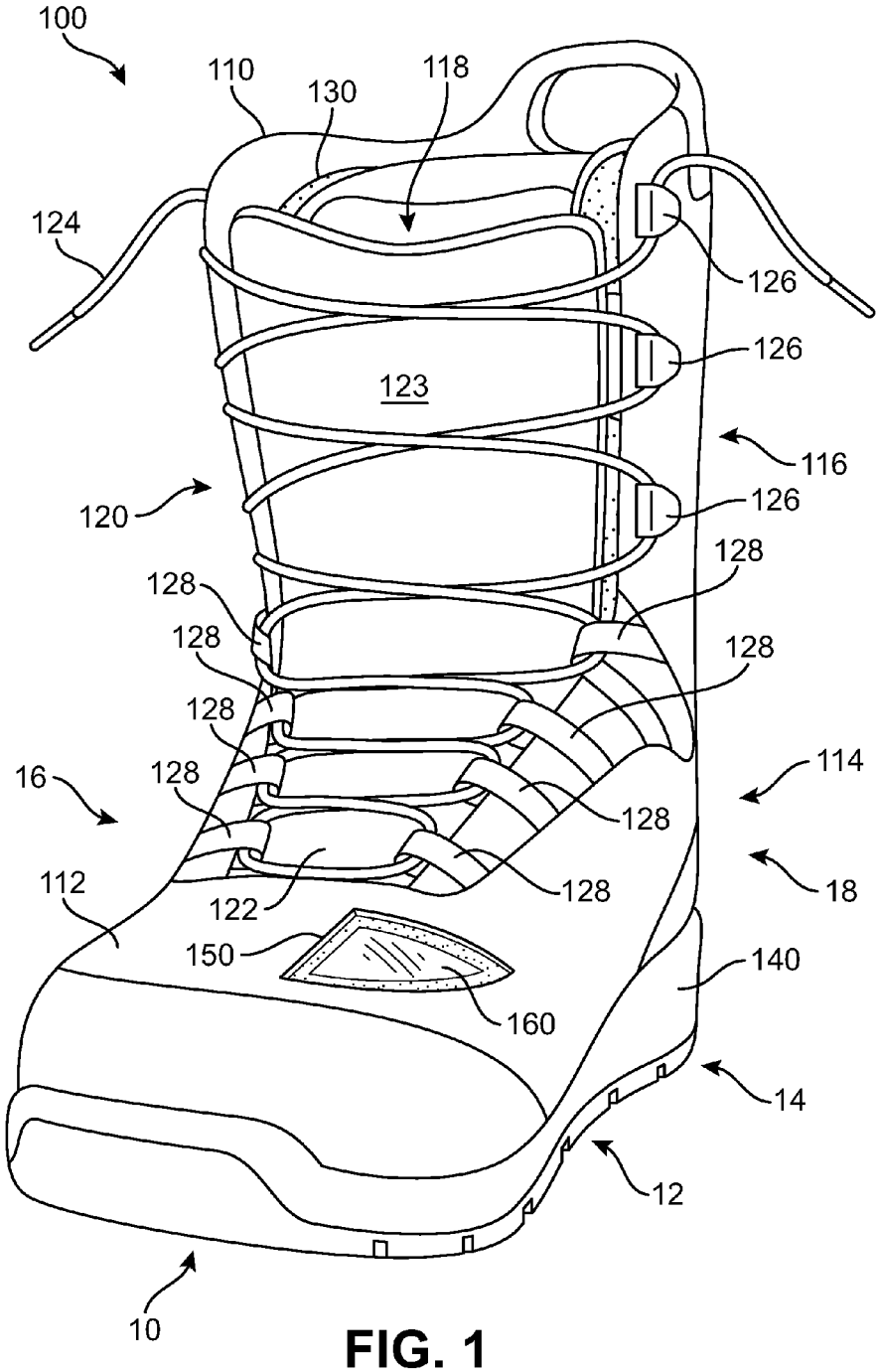
FIG. 1 is an isometric view of an exemplary embodiment of an article of footwear.
Figure 2:
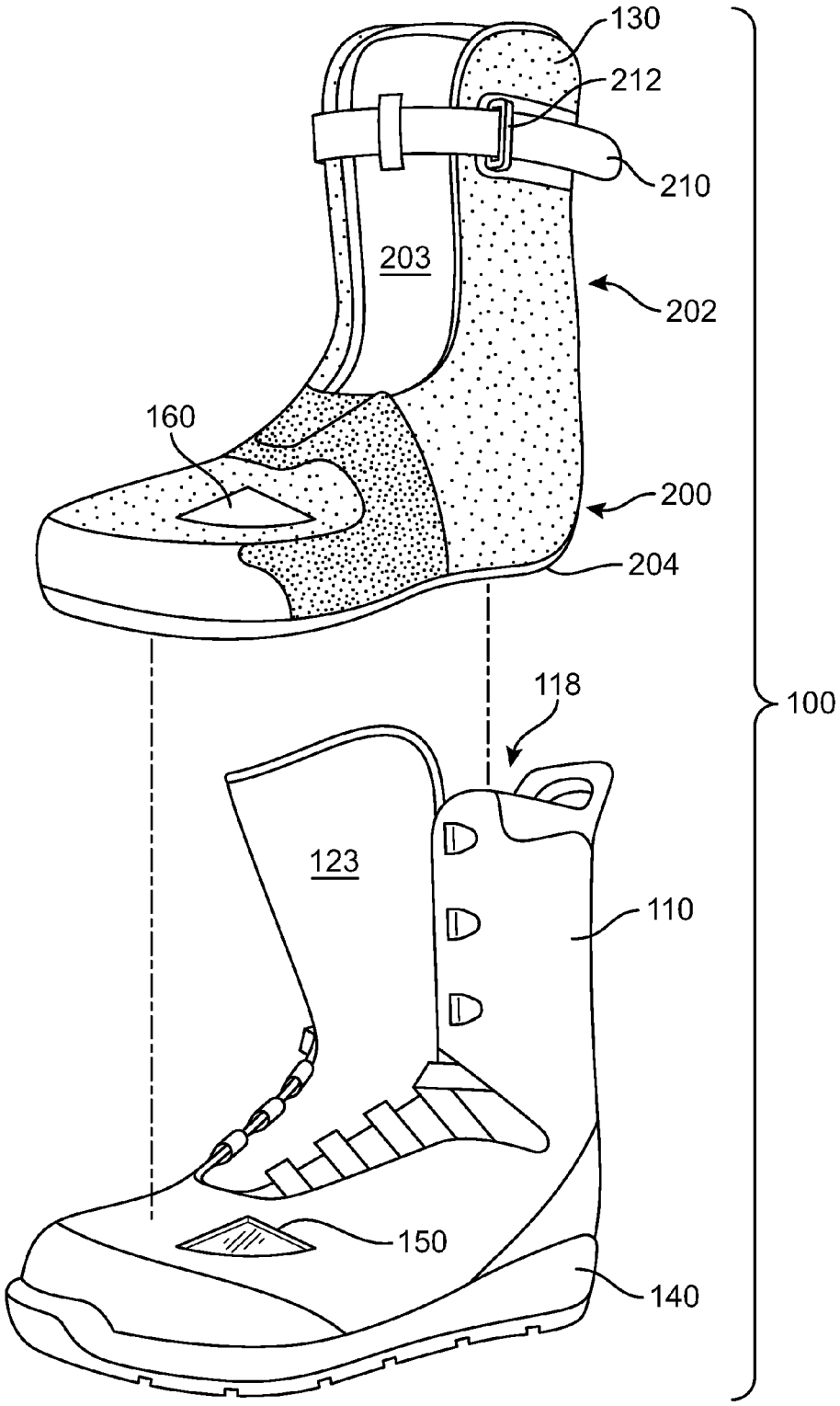
FIG. 2 is an exploded isometric view of an exemplary embodiment of an article of footwear.

FIGS. 1-2 illustrate an exemplary embodiment of article of footwear 100. In particular, FIG. 1 illustrates an isometric view of an exemplary embodiment of article of footwear 100 and FIG. 2 illustrates an exploded isometric view of an exemplary embodiment of article of footwear 100. For clarity, the following detailed description discusses an exemplary embodiment, in the form of a boot, but it should be noted that the present invention could take the form of any article of footwear including, but not limited to: hiking boots, soccer shoes, football shoes, sneakers, rugby shoes, baseball shoes as well as other kinds of shoes. Furthermore, the exemplary embodiments illustrate a boot configured to be used for snowboarding, however, in other embodiments the boot could be used for other activities such as hiking, skiing, or any other type of activity in which boots may be used.

As shown in FIGS. 1-2, article of footwear 100, also referred to simply as article 100, can be used with a right foot. It is understood that the following discussion may equally apply to a mirror image of article of footwear 100 that can be used with a left foot. Features discussed herein may apply equally well for an article of footwear configured for use with a left foot or for a right foot. However, some features discussed herein or configurations shown may provide particular advantages to an article of footwear configured for use with either a left foot or a right foot, such as a snowboard boot arranged for use as the lead boot for a user having a left or goofy foot stance.

For purposes of reference, article 100 may be divided into forefoot region 10, midfoot region 12 and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot region 10, midfoot region 12 and heel region 14.

It will be understood that forefoot region 10, midfoot region 12 and heel region 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot region 10, midfoot region 12 and heel region 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole.

In some embodiments, article 100 may include an outer shell 110 and an inner liner 130. Outer shell 110 and inner liner 130 may be removably associated with one another. In an exemplary embodiment, outer shell 110 may be configured to receive inner liner 130 within an interior of outer shell 110 to form article 100. With this configuration, inner liner 130 may be inserted and removed from outer shell 110.

In some embodiments, outer shell 110 may include an upper 112 and sole structure 140. Sole structure 140 is secured to upper 112 and extends between the foot and the ground when article 100 is worn. In different embodiments, sole structure 140 may include different components. For example, sole structure 140 may include an outsole, a midsole, and/or an insole. In some cases, one or more of these components may be optional.

In some embodiments, sole structure 140 may be configured to provide traction for article 100. In addition to providing traction, sole structure 140 may attenuate ground reaction forces when compressed between the foot and the ground during walking, running or other ambulatory activities. The configuration of sole structure 140 may vary significantly in different embodiments to include a variety of conventional or non-conventional structures. In some cases, the configuration of sole structure 140 may be configured according to one or more types of ground surfaces on which sole structure 140 may be used. Examples of ground surfaces include, but are not limited to: natural turf, synthetic turf, dirt, as well as other surfaces.

In embodiments where article of footwear 100 is a snowboard boot, sole structure 140 may include provisions for interacting with a snowboard. For example, in some cases, sole structure 140 may include features for receiving, and fastening to, bindings on a snowboard. Furthermore, sole structure 140 may include traction members to enhance grip between article 100 and a snowboard. For purposes of clarity, sole structure 140 is shown without any particular features for associating with a snowboard, but it will be understood that in different embodiments any such provisions known in the art may be used.

In some embodiments, upper 112 of outer shell 110 may be configured to receive inner liner 130 including a foot of a wearer of article 100. Generally, upper 112 may be any type of upper. In particular, upper 112 could have any design, shape, size and/or color. For example, in embodiments where article 100 is a basketball shoe, upper 112 could be a high top upper that is shaped to provide high support on an ankle. In embodiments where article 100 is a running shoe, upper 112 could be a low top upper. In an exemplary embodiment, upper 112 has the shape of a boot upper that completely covers a foot and provides additional coverage at an ankle.

In an exemplary embodiment, upper 112 of outer shell 110 may be provided with a lower portion 114 and an upper portion 116. In some cases, lower portion 114 may be associated with, and configured to receive, the toes, arch and heel of a foot. Upper portion 116 may extend upwards from lower portion 114. In some cases, upper portion 116 may be associated with an ankle of a foot. In an exemplary embodiment, upper portion 116 may be a cuff portion for upper 112 of outer shell 110.

Upper 112, including both lower portion 114 and upper portion 116, may define a void in article 100 for receiving and securing inner liner 130 including a foot relative to sole structure 140. In particular, the void is shaped to accommodate inner liner 130 including a foot and extends along the lateral side of the foot, along the medial side of the foot, over the foot and under the foot. In some cases, outer shell 110 may be provided with an entry hole 118 that provides access to the void within upper 112. In an exemplary embodiment, entry hole 118 may be provided at top end of upper portion 116.

Article 100 may include lacing system 120 for purposes of adjusting upper 112. In some cases, lacing system 120 may extend from forefoot region 10 through midfoot region 12 of article 100. Furthermore, in some cases, lacing system 120 may extend through lower portion 114 and upper portion 116 of upper 112. In particular, lacing system 120 may be associated with lacing region 122 that is disposed between lateral side 16 and medial side 18 of upper 112.

In some embodiments, upper 112 may include a tongue 123 that extends through lacing region 122 of upper 112. In some cases, tongue 123 may be integrally formed with upper 112. In other cases, however, tongue 123 may be a separate component from upper 112 and may be attached to upper 112 using conventional methods such as stitching or adhesives. In some cases, tongue 123 may include padding or other cushioning material to provide comfort to a foot of a wearer of article 100.

In some embodiments, lacing system 120 may include lacing member 124. The term "lacing member", as used throughout this detailed discussion, refers to any type of lace that may be used with an article of footwear. Generally, the size, including cross sectional shape and length, of lacing member 124 may be varied. Also, lacing member 124 may be made of any material, including, but not limited to: various types of natural and/or synthetic fibers, as well as other types of materials that may be used as laces. Furthermore it should be understood that although a single lacing member is shown in this preferred embodiment, other embodiments may incorporate more than one lace.

In some embodiments, lacing system 120 may include provisions for securing lacing member 124 to various portions of upper 112 and outer shell. In some embodiments, lacing system 120 may include lace receiving members configured to receive portions of lacing member 124. In other words, these lace receiving members may function in a similar manner to traditional eyelets. In different embodiments, different types of lace receiving members may be used. Examples of different lace receiving members include but are not limited to: eyelets, hooks, lace loops, as well as other types of lace receiving members.

In some embodiments, lacing system 120 may include lace hook members 126. In particular, lace hook members 126 may include a plurality of lace hook members disposed on either side of lacing gap 122 along a medial edge and a lateral edge of upper portion 116 of upper 112 on outer shell 110. In an exemplary embodiment, lace hook members 126 may be traditional types of lace hooks. Generally, lace hooks of lace hook members 126 may have any shape that is configured to receive lacing member 124 for the purposes of tightening the medial edge and the lateral edge on opposite sides of lacing gap 122 on upper portion 116 of upper 112. It will be understood that in other embodiments, different types of lace receiving members could be used in place of lace hooks.

In some embodiments, lacing system 120 may further include lace loop members 128. In particular, lace loop members 128 may include a plurality of lace loop members disposed on either side of lacing gap 122 along a medial edge and a lateral edge of lower portion 114 of upper 112 on outer shell 110. In an exemplary embodiment, lace loops of lace loop members 128 may have any shape that is configured to receive lacing member 124 for the purposes of tightening the medial edge and lateral edge on opposite sides of lacing gap 122 on lower portion 114 of upper 112. It will be understood that in other embodiments, different types of lace receiving members could be used in place of lace loops.

In different embodiments, the materials used for the various components of article 100 may vary. For example, sole structure 140 may be made from any suitable material, including, but not limited to: elastomers, siloxanes, natural rubber, other synthetic rubbers, aluminum, steel, natural leather, synthetic leather, or plastics. In some cases, the materials used for making sole structure 140 may be selected to accomplish stability and cushioning for a foot undergoing forces typically associated with snowboarding.

Also, outer shell 110 and/or upper 112 may be made from any suitable material. Examples of materials for outer shell 110 and/or upper 112 include, but are not limited to: nylon, natural leather, synthetic leather, natural rubber or synthetic rubber. In some cases, outer shell 110 and/or upper 112 may be made of any suitable knitted, woven or non-woven material. In an exemplary embodiment, outer shell 110 and/or upper 112 may be made of a combination of layers. For example, in some cases, outer shell 110 and/or upper 112 may be provided with an outer layer made of synthetic leather, which can enhance the durability of upper 112. The outer layer can be reinforced on an interior side of upper 112 by an inner layer made of, for example, a synthetic fabric that provides padding and/or insulation.

In an exemplary embodiment, article 100 may include inner liner 130 that is configured to be inserted into entry hole 118 within the interior of outer shell 110 to fill the void defined by upper 112. Inner liner 130 may be made from any suitable material. Examples of materials for inner liner 130 include, but are not limited to: nylon, cotton, polyester, natural and/or synthetic fibers or blends, as well as any of the materials used for upper 112, including natural leather, synthetic leather, natural rubber, and/or synthetic rubber. In some cases, inner liner 130 may be made of any suitable knitted, woven or non-woven material. In an exemplary embodiment, inner liner 130 may be made of a combination of materials. In some cases, inner liner 130 may be made of a material that is configured to provide comfort to a foot of a wearer when disposed within article 100. In an exemplary embodiment, inner liner 130 may be made of a combination of layers. For example, in some cases, inner liner 130 may be provided with an outer layer that is configured to be disposed along the inside of outer shell 110 and an inner layer that is configured to be disposed within the interior of inner liner 130.

In some embodiments, article 100 may be provided with an indicator associated with a heating system. In one embodiment, the heating system may be disposed within inner liner 130 such that the heating system may be removed with inner liner 130 when inner liner 130 is removed from outer shell 110. In an exemplary embodiment, outer shell 110 of article 100 may be provided with a viewing window 150 disposed in forefoot region 10 of upper 112 so that a portion of inner liner 130 may be visible through upper 112 of outer shell 110. In one embodiment, inner liner 130 may include an indicator 160 disposed on a corresponding location in the forefoot region 10 of inner liner 130 such that indicator 160 may be visible through viewing window 150 on upper 112 of outer shell 110. Indicator 160 may be associated with the heating system of inner liner 130 such that indicator 160 displays a status condition of the heating system. With this arrangement, indicator 160 may be viewed by a wearer of article 100 through viewing window 150 to receive information about the status of the heating system disposed within article 100.

Referring now to FIG. 2, an exploded view of article 100, including outer shell 110 and inner liner 130, is illustrated. In this embodiment, inner liner 130 may be seen removably disposed from within the interior of outer shell 110. As discussed above, in some embodiments, inner liner 130 may be inserted and withdrawn from outer shell 110 through entry hole 118.

In an exemplary embodiment, inner liner 130 may have a corresponding shape as outer shell 110. For example, in cases where outer shell 110 and/or upper 112 is configured to be a low top upper, inner liner 130 may have a similar shape. In this embodiment, where outer shell 110 and/or upper 112 is a boot, inner liner 130 may have a corresponding shape. In an exemplary embodiment, inner liner 130 may be provided with a lower liner portion 200 and an upper liner portion 202. In some cases, lower liner portion 200 may be associated with, and configured to receive, the toes, arch and heel of a foot. Upper liner portion 202 may extend upwards from lower liner portion 200. In some cases, upper liner portion 202 may be associated with an ankle of a foot. In an exemplary embodiment, upper liner portion 202 may be a cuff portion for inner liner 130.

In an exemplary embodiment, inner liner 130 may include a bottom 204 disposed on lower liner portion 200. Bottom 204 of inner liner 130 may be configured to rest along the bottom interior of outer shell 110 inside of upper 112. In some cases, bottom 204 may be made of a different material from the rest of inner liner 130 that is configured to provide traction or friction with the interior of outer shell 110. In other cases, bottom 204 may be treated with an applied coating or material to increase the traction or friction with the interior of outer shell 110. In one embodiment, bottom 204 may include a rubberized coating.

In some embodiments, inner liner 130 may include a tongue 203 that extends through upper liner portion 202 and into a portion of lower liner portion 200. In an exemplary embodiment, tongue 203 may correspond approximately to lacing region 122 of upper 112. In some cases, tongue 203 may be integrally formed with inner liner 130. In other cases, however, tongue 203 may be a separate component from inner liner 130 and may be attached to inner liner 130 using conventional methods such as stitching or adhesives. In some cases, tongue 203 may include padding or other cushioning material to provide comfort to a foot of a wearer of article 100.

In some embodiments, inner liner 130 may be provided with a fastening member 210. Fastening member 210 may be a strap or other mechanism that is configured to tighten upper liner portion 202 of inner liner 130 on a foot of a wearer. In an exemplary embodiment, fastening member 210 may be secured to inner liner 130 on a first side and may be adjustably secured to an anchor 212 disposed on the exterior of inner liner 130 on a second side to allow fastening member 210 to be drawn tight. In one embodiment, fastening member 210 may include hook and loop fasteners to hold fastening member 210 in a closed position on inner liner 130. In other embodiments, other tightening or fastening mechanisms may be used to tighten inner liner 130 around a foot of a wearer.

As shown in FIG. 2, the location of viewing window 150 disposed on outer shell 110 may generally correspond to the location of indicator 160 disposed on inner liner 130. In an exemplary embodiment, viewing window 150 may be disposed along a top portion of upper 112 in forefoot region 10 of outer shell 110. In this embodiment, viewing window 150 is disposed offset to medial side 18. However, in other embodiments, viewing window 150 may be disposed offset to lateral side 16 or disposed approximately in the center of the top portion of upper 112 in forefoot region 10 of outer shell 110. In an exemplary embodiment, indicator 160 may be disposed along a top portion of inner liner 130 in forefoot region 10. In one embodiment, indicator 160 may be configured to align with viewing window 150 when inner liner 130 is disposed within the interior of outer shell 110. With this arrangement, indicator 160 may be visible within the interior of outer shell 110 through viewing window 150 in upper 112.

Figure 3:
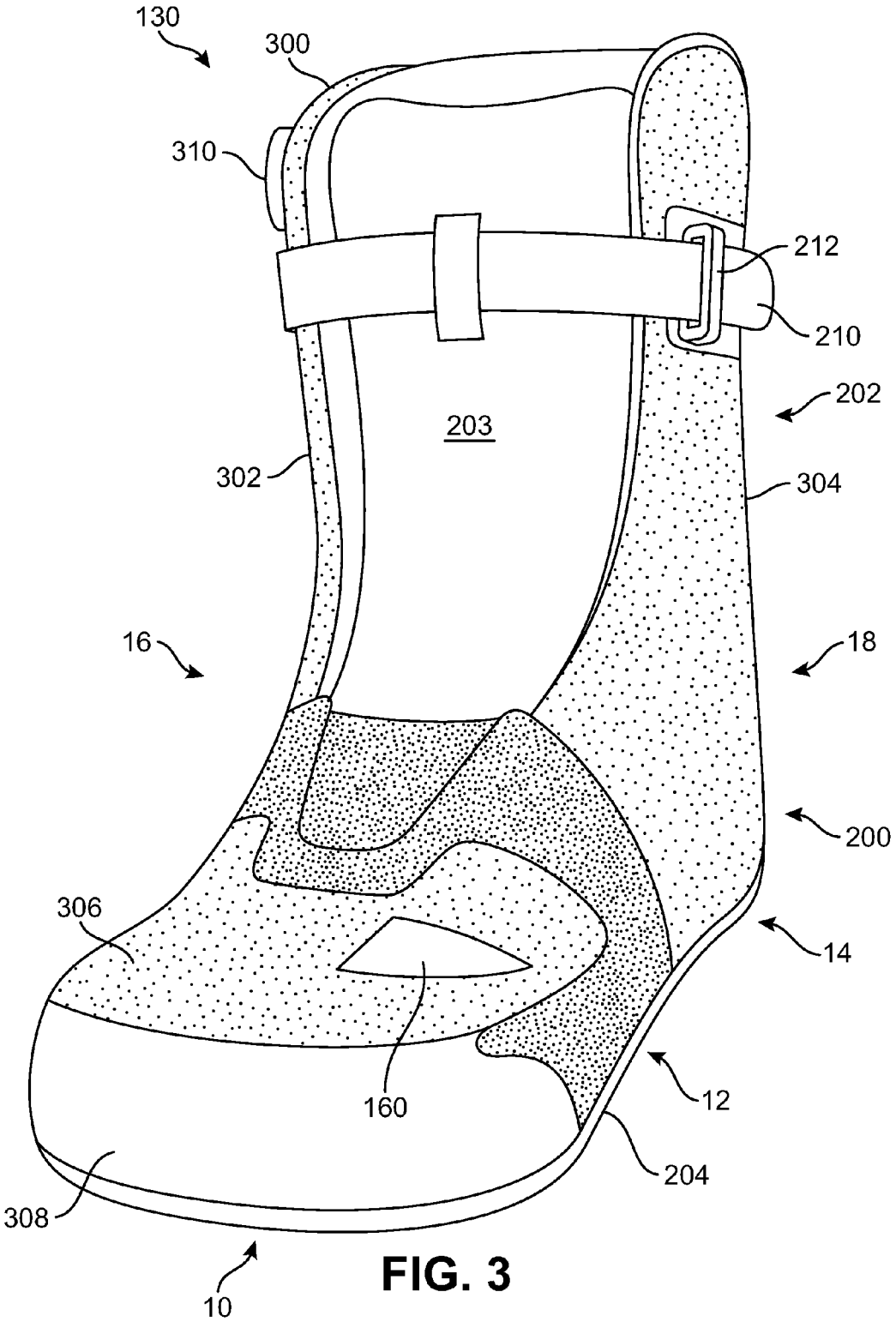
FIG. 3 is an isometric view of an exemplary embodiment of an inner liner for an article of footwear.

FIG. 3 illustrates an isometric view of inner liner 130. In an exemplary embodiment, inner liner 130 may be configured for insertion in outer shell 110 to form a boot. In this embodiment, inner liner 130 includes a top edge 300 of upper liner portion 202. Top edge 300 is disposed along the top of inner liner 130 and extends from lateral side 16 to medial side 18. Upper liner portion 202 also includes a front edge 302. Front edge 302 extends from top edge 300 of upper liner portion 202 downwards towards lower liner portion 200 along the front of inner liner 130. In an exemplary embodiment, front edge 302 may include a first front edge disposed on lateral side 16 and a second front edge disposed on medial side 18, disposed on either side of tongue 203. In an exemplary embodiment, top edge 300 and front edge 302 together may be associated with a cuff portion of upper liner 202.

In some embodiments, a rear portion 304 may be disposed along the back of inner liner 130 opposite front edge 302 extending through upper liner portion 202 and lower liner portion 200. Rear portion 304 may be associated with a heel and achilles tendon of a foot of a wearer. In an exemplary embodiment, lower liner portion 200 may include a top forefoot portion 306 extending along a top of lower liner portion 200. Top forefoot portion 306 may extend over the top or instep of a foot and extend towards the toe end of inner liner 130. In an exemplary embodiment, the toe end of inner liner 130 may include a toe cap perimeter 308 that extends along the perimeter of the toe end of forefoot region 10 of lower liner portion 200. Toe cap perimeter 308 may extend vertically between top forefoot portion 306 and bottom 204 of inner liner 130. In some embodiments, toe cap perimeter 308 may extend approximately along an outer edge of forefoot region 10 continuously from lateral side 16 to medial side 18.

In some embodiments, inner liner 130 may be configured with components to provide heating or warming to the interior of inner liner 130. In an exemplary embodiment, inner liner 130 may include a heating system with one or more heating elements that are configured to warm the toes and foot of a wearer when disposed within inner liner 130. Any heating system known in the art may be used with inner liner 130, including the heating system disclosed in co-pending and commonly owned U.S. Publication Number 2014/0059882, published on Mar. 6, 2014, U.S. Ser. No. 13/597,506, entitled "Article of Footwear with a Heating System," filed on Aug. 29, 2012. With this arrangement, inner liner 130, including one or more heating elements, may be disposed within outer shell 110 to provide a heated boot that may worn by a wearer in cold weather conditions while providing heat and/or warmth to the wearer's toes and feet.

In this embodiment, lateral side 16 of inner liner 130 includes a control mechanism 310 that may be associated with one or more components of a heating system. Control mechanism 310 may be associated with a power button, switch or other control device, including an electronic control unit (ECU) associated with a computer or CPU, disposed on an outer surface of upper liner portion 202. In an exemplary embodiment, control mechanism 310 may be disposed adjacent to top edge 300 of the cuff of upper liner portion 202. With this arrangement, control mechanism 310 may be easily depressed or accessed by a wearer of article 100.

In some embodiments, inner liner 130 may further include indicator 160. As discussed above, indicator 160 may be associated with the heating system of inner liner 130 such that indicator 160 displays a status condition of the heating system. In an exemplary embodiment, indicator 160 may be one or more lighting devices. The term "lighting device" as used throughout this detailed description and in the claims refers to any device configured for illumination. In different embodiments, different types of lighting devices can be used including, but not limited to, incandescent bulbs, light emitting diodes (LEDs), LED panels, florescent lights, high intensity discharge lamps, electro-luminescent panels (ELP), as well as other types of devices. In some cases, each lighting device may be associated with an illuminated condition, also referred to as an "on" state of the device, and a non-illuminated condition, also referred to as an "off" state of the device.

Figure 4:
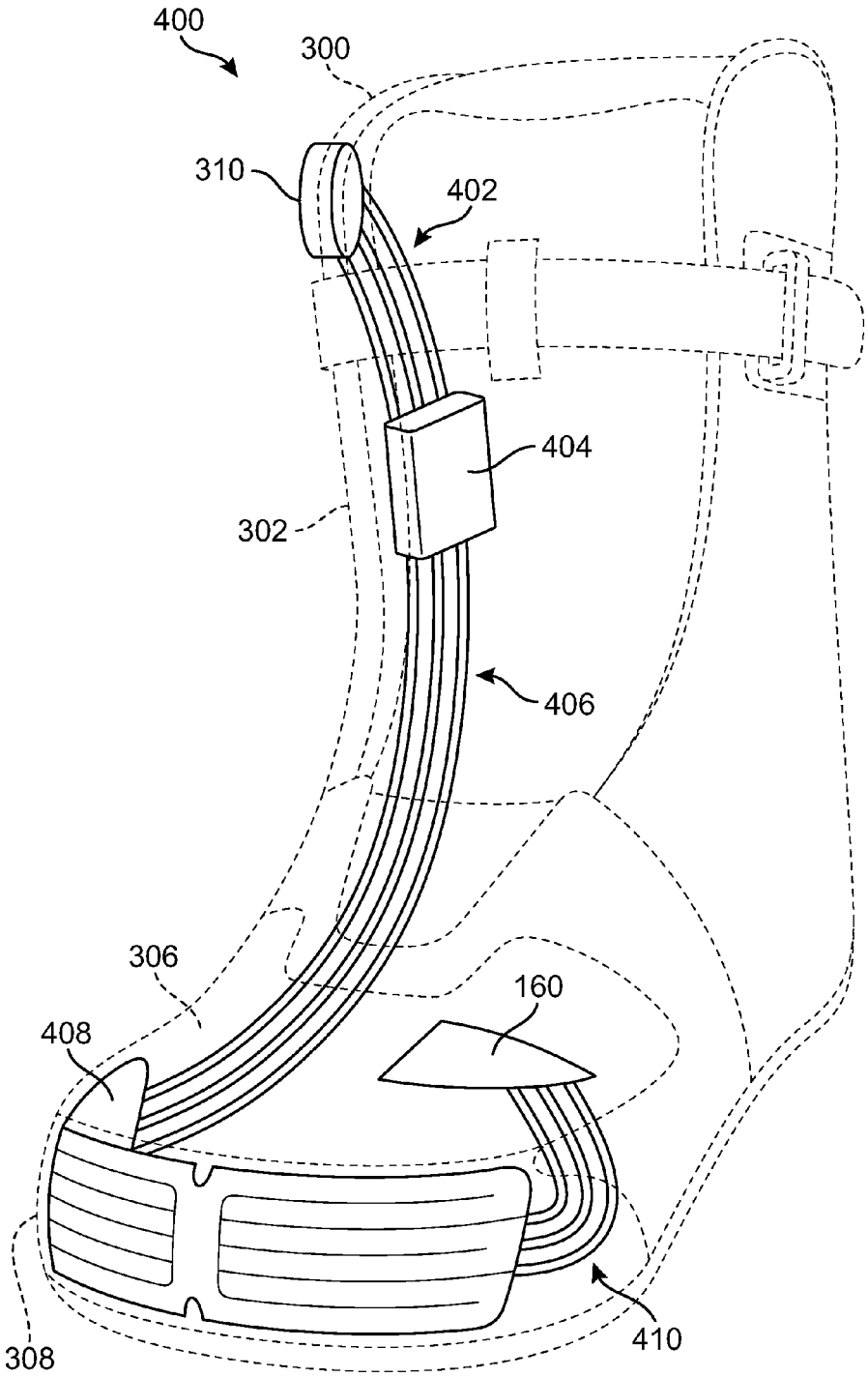
FIG. 4 is an isometric view of an exemplary embodiment of an inner liner for an article of footwear including an indicator and heating system with the liner illustrated in phantom.

FIG. 4 illustrates an exemplary embodiment of a heating system 400 including indicator 160 disposed within inner liner 130. In some embodiments, heating system 400 may include one or more electronic components that are integrated within inner liner 130. In an exemplary embodiment, heating system 400 may be completely disposed within inner liner 130 so that heating system 400 is removably associated with article 100 when inner liner 130 is removed from within the interior of outer shell 110. With this arrangement, various electronic components of heating system 400 do not require an electrical connection between inner liner 130 and outer shell 110.

In addition, by providing article 100 with heating system 400 disposed within inner liner 130 so that heating system 400 is not connected with outer shell 110, inner liner 130 with heating system 400 may be completely removed from outer shell 110. In an exemplary embodiment, heating system 400 may be operated while outside of outer shell 110. With this arrangement, heating system 400 may be used for drying inner liner 130 while removed from outer shell 110. In some embodiments, heating system 400 may be provided with a setting that corresponds to a drying function.

In some embodiments, heating system 400 may include control mechanism 310, discussed above, for controlling various functions associated with heating system 400. In an exemplary embodiment, control mechanism 310 may be configured to turn power on and off to heating system 400. In some embodiments, control mechanism 310 may be configured to control other functions associated with heating system 400, including changing between one or more power or heating settings. For example, control mechanism 310 may be configured to switch heating system 400 between an off state, a low power state, and a high power state. In other embodiments, additional levels of power or heating may be controlled using control mechanism 310.

In addition, control mechanism 310 may be further configured to control indicator 160. In an exemplary embodiment, control mechanism 310 may switch indicator 160 between a non-illuminated condition and an illuminated condition based upon the status of heating system 400. In other embodiments, control mechanism 310 may cause indicator 160 to display or indicate other status information. For example, in cases where heating system has multiple power or heating settings, control mechanism 310 may control indicator 160 between various states of indication, including varying levels of brightness, portions or degrees of illumination, and one or more colors of illumination associated with indicator 160.

In an exemplary embodiment, power for the components associated with heating system 400, including indicator 160, may be provided by a power source 404. In one embodiment, power source 404 may be a rechargeable battery that is configured to supply electrical power to the various components of heating system 400. In other embodiments, power source 404 may be any other known kind of battery or other source of electrical power. In some embodiments, heating system 400 may further include components configured to transmit signals and/or power to the various components of heating system 400. In an exemplary embodiment, heating system 400 may include wires 402 connecting control mechanism 310 and power source 404. Similarly, wires 406 may connect power source 404 and/or control mechanism 310 with additional components of heating system 400, including a heating element 408. In some embodiments, wires 410 may connect heating element 408 and indicator 160. In other embodiments, additional or different wires may connect indicator 160 to control mechanism 310 directly or indirectly.

It should be understood that the exact location and electronic components illustrated in FIG. 4 that are associated with heating system 400 are exemplary and in other embodiments, heating system 400 may have a different configuration, including additional or fewer components. In some embodiments, heating system 400 may include a thermistor or thermostat (not shown) for controlling and/or determining the temperature associated with heating system 400 or the interior of article 100. Control mechanism 310 may be configured to use information from the thermistor or thermostat to control the operation of heating system 400, including the determination of power or heating levels or settings. Heating system 400 may further include other known components that are associated with a heating system for an article of footwear, including various wires, connections, ports, circuitry, and controls that are known in the art.

In some embodiments, heating system 400 may include a toe cap heating element 408. Toe cap heating element 408 may be connected to power source 404 and/or control mechanism 310 via wires 406. In an exemplary embodiment, toe cap heating element 408 may be disposed along the toe cap perimeter 308 of inner liner 130. Toe cap heating element 408 may be disposed along an interior of forefoot region 10 of inner liner 130 along the perimeter of the toe end of lower liner portion 200. In an exemplary embodiment, toe cap heating element 408 may extend vertically between top forefoot portion 306 and bottom 204 of inner liner 130. In one embodiment, toe cap heating element 408 extends only along toe cap perimeter 308 and does not extend over onto top forefoot portion 306 and/or under onto bottom 204. In some embodiments, toe cap heating element 408 may extend approximately along an outer edge of forefoot region 10 continuously from lateral side 16 to medial side 18. With this arrangement, toe cap heating element 408 may provide heat and/or warmth to the toes and foot of a wearer when disposed within inner liner 130.

Figure 5:
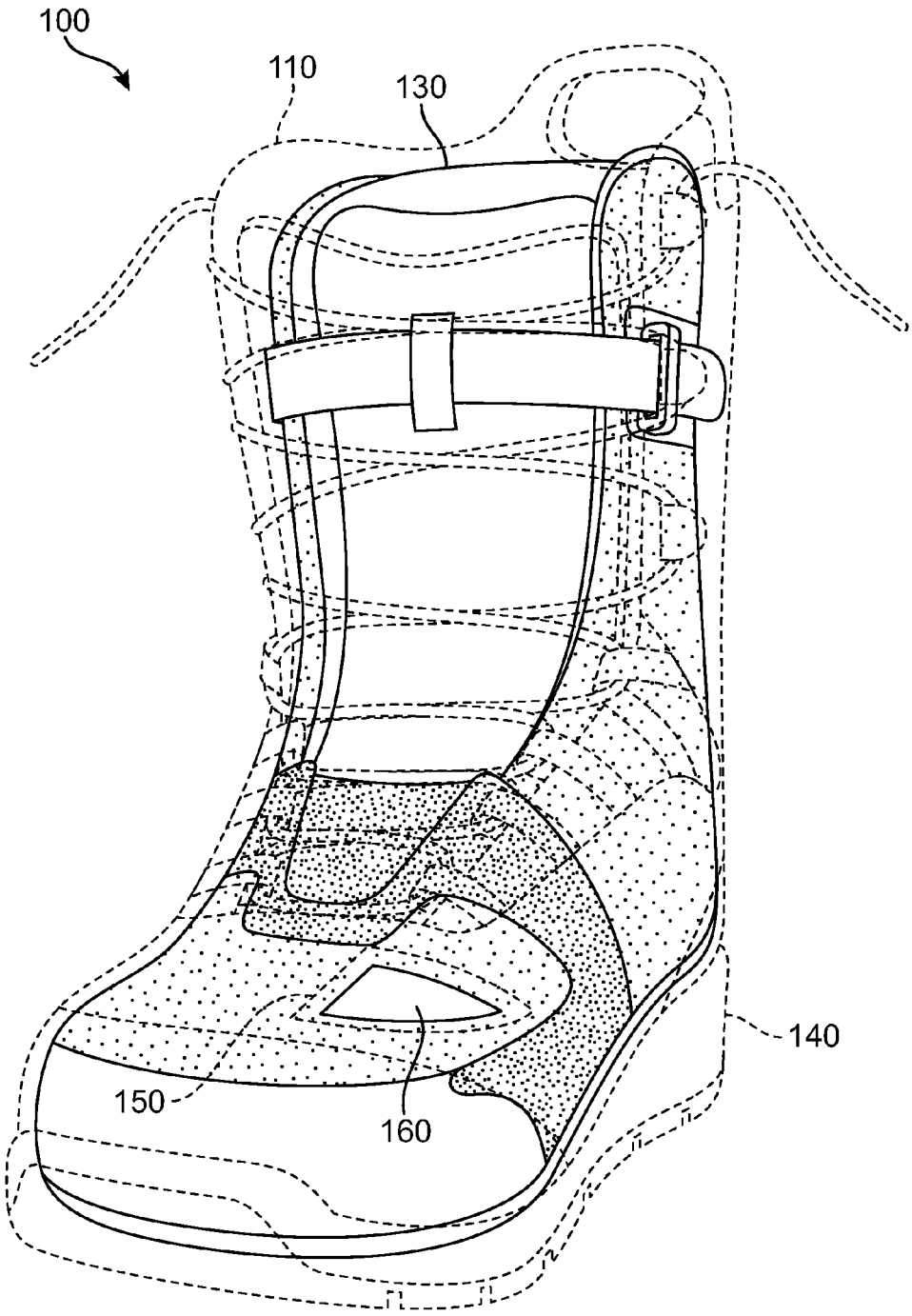
FIG. 5 is an isometric view of an exemplary embodiment of an inner liner disposed within an outer shell of an article of footwear with the outer shell illustrated in phantom.

FIG. 5 illustrates an isometric view of inner liner 130 disposed within outer shell 110 of article of footwear 100 with outer shell 110 illustrated in phantom. As shown in this embodiment, the location of viewing window 150 disposed on outer shell 110 and the location of indicator 160 on inner liner 130 correspond such that indicator 160 is aligned with viewing window 150. With this arrangement, indicator 160 may be visible by a wearer of article 100 through outer shell 110 to determine the status condition of the heating system within the interior of article 100.

Figure 6:
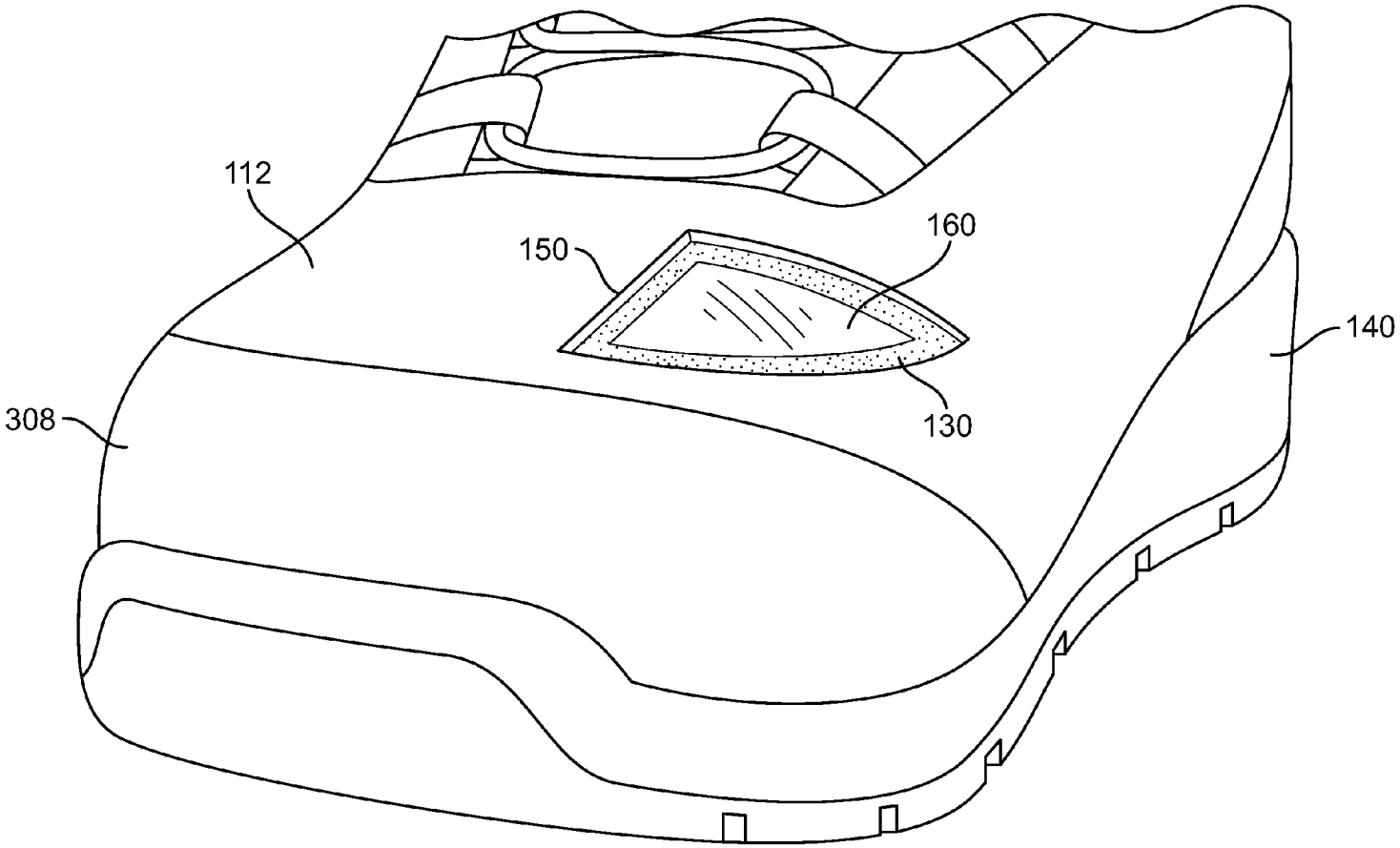
FIG. 6 is an enlarged view of an exemplary embodiment of a forefoot region of an article of footwear including an indicator.

FIG. 6 illustrates a close up view of forefoot region 10 of article 100, including viewing window 150 disposed on upper 112 of outer shell 110 and indicator 160 disposed on inner liner 130. In some embodiments, viewing window 150 may be configured to allow light from indicator 160 to pass through viewing window 150 and be visible to a wearer of article 100. Viewing window 150 may be made from any suitable materials, including, but not limited to: transparent, semi-transparent, translucent, and semi-translucent materials. In an exemplary embodiment, viewing window 150 may be a transparent plastic or polymer material. In addition, in some embodiments, viewing window 150 may be secured, attached, or bonded to upper 112 within a cut-out portion of upper 112 so as to form an approximately uniform surface across the top portion of upper 112. Viewing window 150 may further be associated with upper 112 such that viewing window 150 seals the cut-out portion of upper 112 to prevent any entry to water or other elements into the interior of article 100. With this arrangement, outer shell 110 may be configured to be water-tight or water-resistant at forefoot region 10.

In an exemplary embodiment, indicator 160 disposed on the corresponding location on inner liner 130 to align with viewing window 150 may be visible through viewing window 150. In some cases, all or substantially all of indicator 160 may be visible through viewing window 150. In other cases, only a portion of indicator 160 may be visible through viewing window 150. With this arrangement, by aligning the locations of indicator 160 disposed on top of inner liner 130 and viewing window 150 disposed on the top portion of upper 112 of outer shell 110, the status of a heating system disposed within the interior of article 100 may be communicated to a wearer.

In an exemplary embodiment, viewing window 150 may be disposed along a top portion of upper 112 in forefoot region 10 of outer shell 110. In this embodiment, viewing window 150 is disposed offset to medial side 18. However, in other embodiments, viewing window 150 may be disposed offset to lateral side 16 or disposed approximately in the center of the top portion of upper 112 in forefoot region 10 of outer shell 110.

In addition, the location of viewing window 150 and indicator 160 may be selected so that indicator 160 is easily and readily viewed by a wearer when wearing article 100 to perform an activity. For example, in embodiments where article 100 is a snowboard boot, the location of viewing window 150 and indicator 160 may be selected to be visible when a wearer is using a snowboard or otherwise wearing clothing that may partially cover a portion of article 100. It should be understood that the exact placement of viewing window 150 and indicator 160 may vary and may be changed to take into account the location of other components associated with article 100, including, for example, bindings used to secure article 100 to a snowboard.

Figure 7:
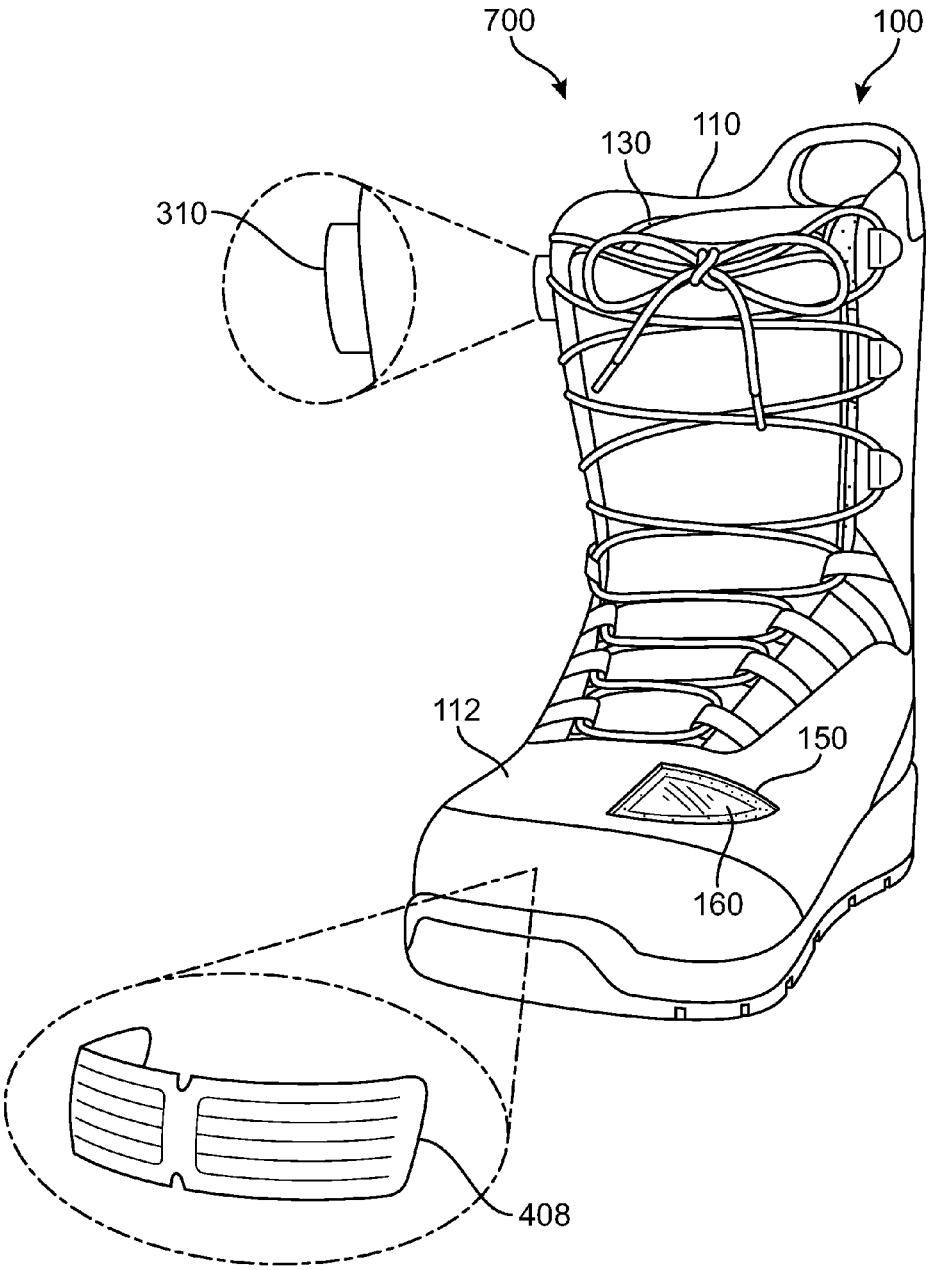
FIG. 7 is a schematic view of an exemplary embodiment of an article of footwear illustrating an indicator for a heating system in a non-illuminated condition.
Figure 8:
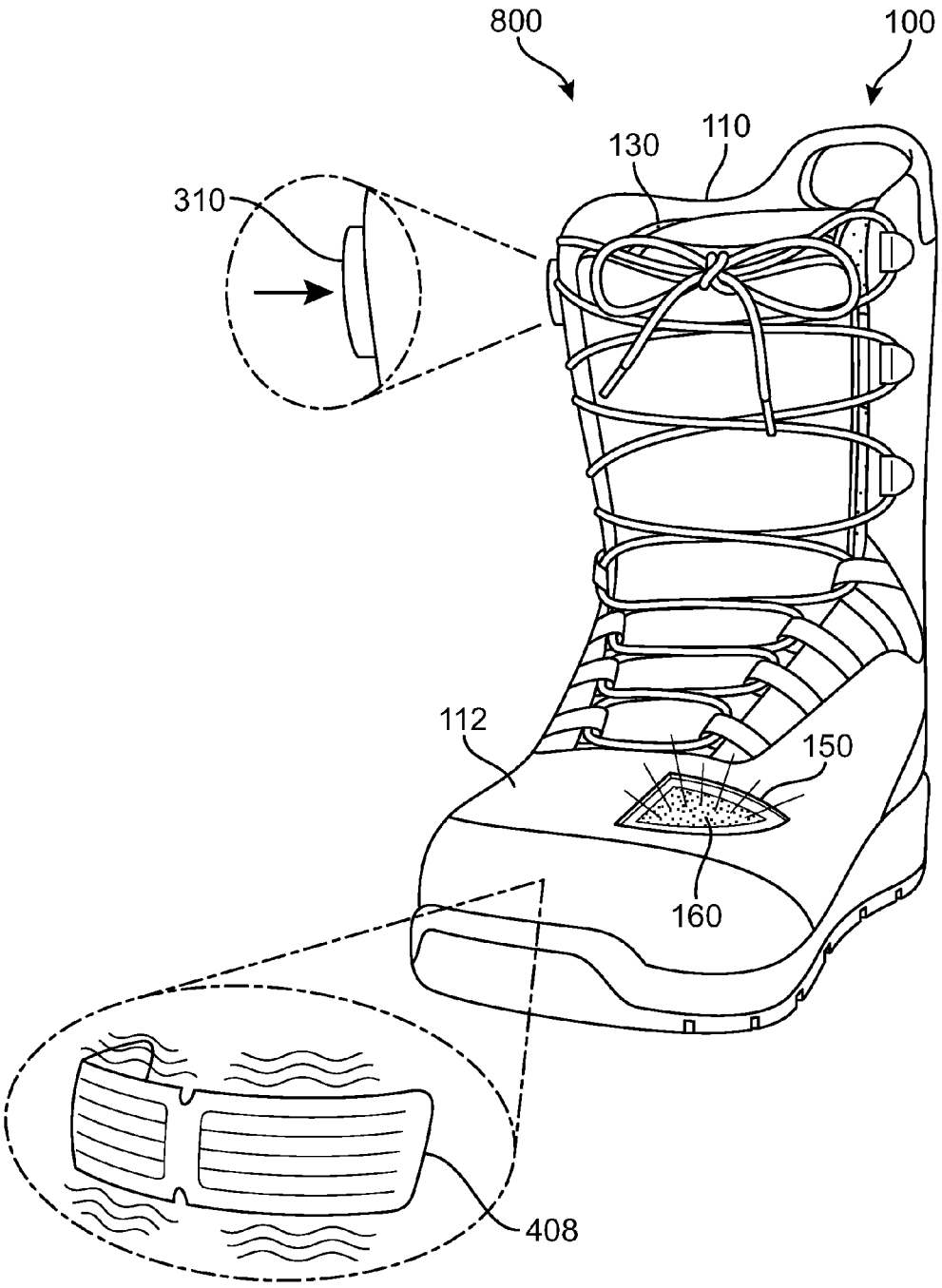
FIG. 8 is a schematic view of an exemplary embodiment of an article of footwear illustrating an indicator for a heating system in an illuminated condition.

FIGS. 7 and 8 illustrate schematic views of the operation of indicator 160 to communicate the status of a heating system to a wearer of article 100. Referring now to FIG. 7, a non-illuminated condition 700 of indicator 160 is shown. In this embodiment, non-illuminated condition 700 of indicator 160 corresponds to an off state of heating element 408. Control mechanism 310 on article 100 has not been actuated or controlled to turn on heating element 408 of the heating system disposed within inner liner 130 inside outer shell 110 of article 100. Accordingly, when heating element 408 and the heating system is in the off state, indicator 160 is in non-illuminated condition 700. In this embodiment, indicator 160 is visible to a wearer of article 100 through viewing window 150 on upper 112 of outer shell 110. With this arrangement, a wearer of article 100 may view indicator 160 in non-illuminated condition 700 to confirm that the heating system is in the off state.

Referring now to FIG. 8, an illuminated condition 800 of indicator 160 is shown. In this embodiment, illuminated condition 800 of indicator 160 corresponds to an on state of heating element 408. Control mechanism 310 on article 100 has been actuated or controlled to turn on heating element 408 of the heating system disposed within inner liner 130 inside outer shell 110 of article 100. Accordingly, when heating element 408 and the heating system is in the on state, indicator 160 is in illuminated condition 800. In this embodiment, indicator 160 is visible to a wearer of article 100 through viewing window 150 on upper 112 of outer shell 110. With this arrangement, a wearer of article 100 may view indicator 160 in illuminated condition 800 to confirm that the heating system is in the on state. By providing viewing window 150 to allow non-illuminated condition 700 and illuminated condition 800 of indicator 160 to be visible to a wearer of article 100, the status condition of the heating system may be communicated to the wearer in a location where it can readily and easily be seen when wearing article 100.

In other embodiments, control mechanism 310 may cause indicator 160 to display or indicate other status information. For example, in cases where heating system has multiple power or heating settings, control mechanism 310 may control indicator 160 between various states of indication, including varying levels of brightness, portions or degrees of illumination, and one or more colors of illumination associated with indicator 160.

Figure 9:
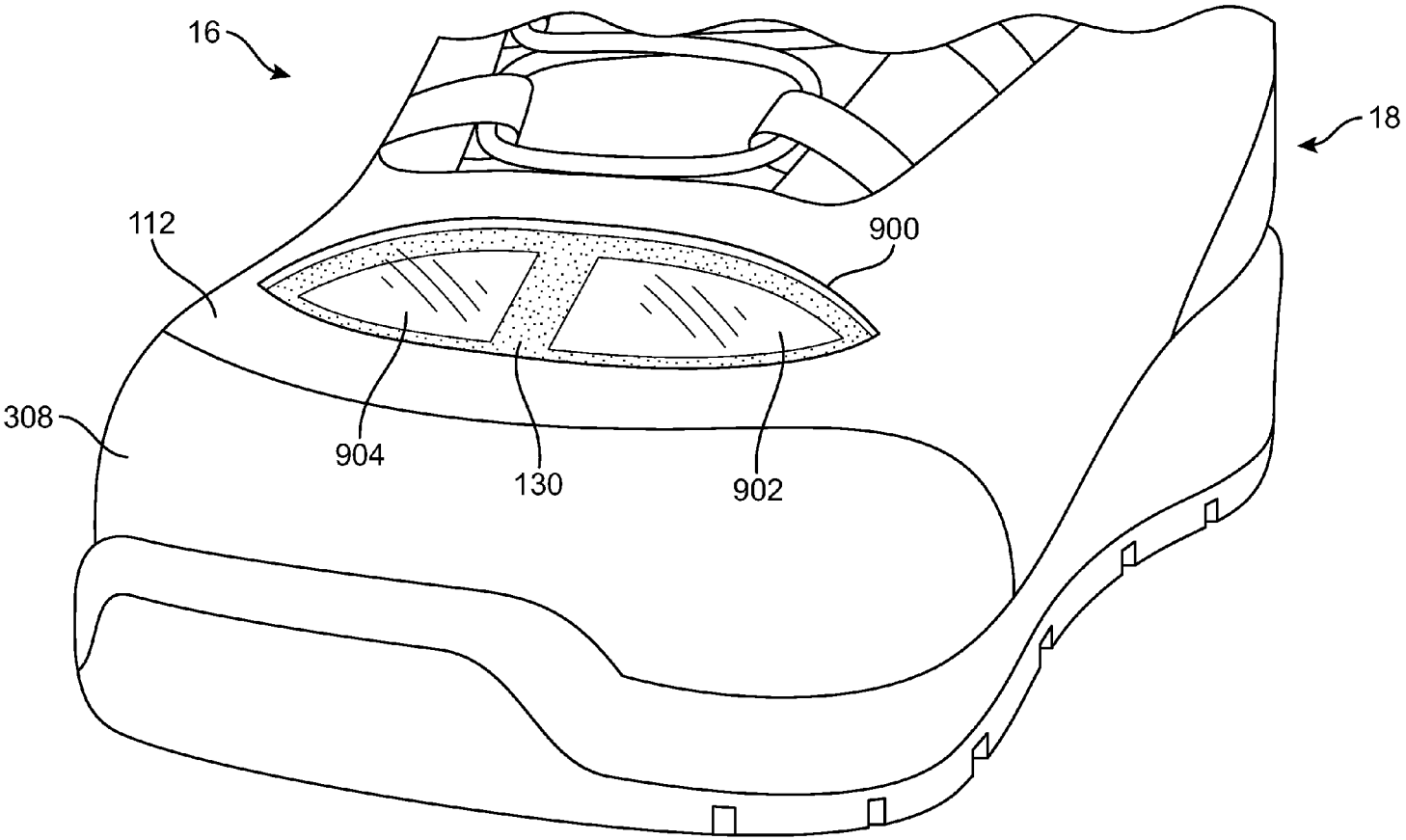
FIG. 9 is an enlarged view of an alternate embodiment of an indicator arrangement disposed on a forefoot region of an article of footwear.

In some embodiments, multiple indicators may be provided on inner liner 130 to provide multiple status condition information associated with a heating system within an interior of an article. Referring now to FIG. 9, an alternate embodiment of an indicator arrangement disposed on forefoot region 10 of article of footwear 100 is illustrated. In this embodiment, upper 112 of outer shell 110 may include a viewing window 900. Viewing window 900 may be substantially similar to viewing window 150, described above. In an exemplary embodiment, viewing window 900 may be larger than viewing window 150.

In one embodiment, viewing window 900 may be disposed along the top portion of upper 112 in forefoot region 10. Viewing window 900 may be configured to have a size that allows multiple indicators disposed on forefoot region 10 of inner liner 130 to be visible through viewing window 900. In this embodiment, a first indicator 902 and a second indicator 904 may be disposed on the top of inner liner 130 at forefoot region 10 and may be aligned with viewing window 900 on outer shell 110. With this arrangement, first indicator 902 and second indicator 904 may be visible to a wearer of article 100 from within the interior of outer shell 110.

In an exemplary embodiment, first indicator 902 and second indicator 904 may be substantially similar to indicator 160, described above. In one embodiment, first indicator 902 and second indicator 904 may be configured to indicate multiple status conditions associated with a heating element or heating elements of the heating system disposed within inner liner 130. In embodiments where the heating system may be controlled between multiple power or heating settings, first indicator 902 and second indicator 904 may be used to communicate the power level or setting of the heating system. For example, in an exemplary embodiment, first indicator 902 may indicate a low power setting and second indicator 904 may indicate a high power setting.

In addition, other information or status conditions may be communicated to a wearer of an article using first indicator 902 and/or second indicator 904, and combinations thereof, including status conditions associated with a heating system or the status conditions associated with other electrical components integrated within inner liner 130.

In other embodiments, one or more non-visual alerts may be used in combination with control mechanism 310 and indicator 160. In some cases, a tactile or haptic alert may be associated with control mechanism 310 to provide a physical indication that control mechanism 310 has been pressed or actuated. For example, a detent or click may be felt when control mechanism 310 is pressed by a user. In other cases, an aural alert may be associated with control mechanism 310 to provide an auditory indication that control mechanism 310 has been pressed or actuated. For example, a sound may be generated through mechanical or electrical methods when control mechanism 310 is pressed by a user.

Figure 10:
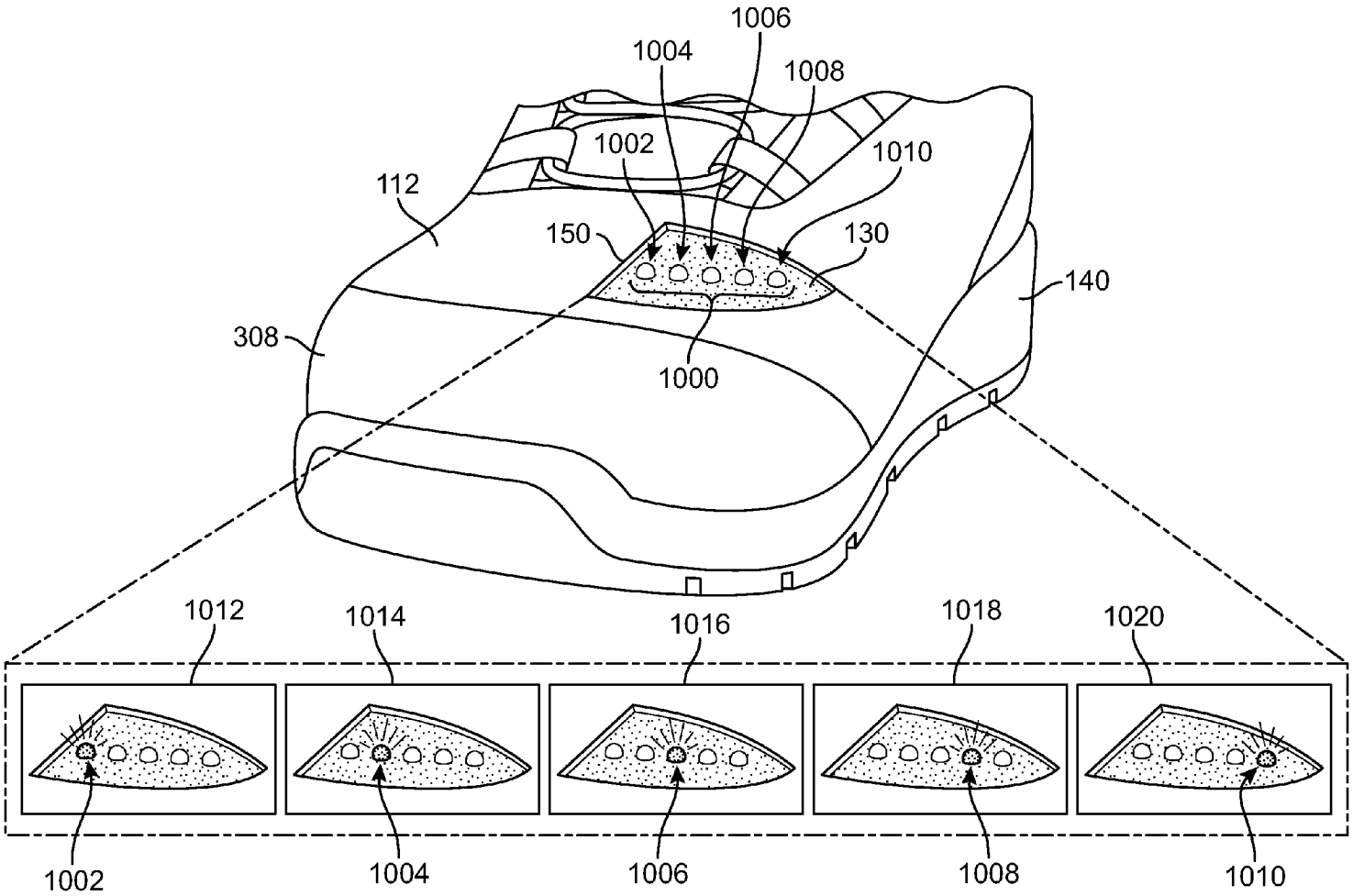
FIG. 10 is an enlarged view of an alternate embodiment of an indicator arrangement disposed on a forefoot region of an article of footwear.

In some embodiments, an indicator may be in the form of one or more LEDs. Referring now to FIG. 10, an alternate embodiment of an indicator arrangement disposed on forefoot region 10 of article of footwear 100 is illustrated. In an exemplary embodiment, a plurality of LED diodes may be configured into an LED array 1000 disposed on forefoot region 10 of inner liner 130. As discussed in previous embodiments, LED array 1000 may be visible through viewing window 150. LED array 1000 may include any number of individual LED diode elements. In this embodiment, LED array 1000 includes five LED diodes, including a first LED diode 1002, a second LED diode 1004, a third LED diode 1006, a fourth LED diode 1008, and a fifth LED diode 1010 disposed on the top of inner liner 130 at forefoot region 10. In an exemplary embodiment, the individual LED diode elements of LED array 1000 may be disposed in approximately a straight line. However, in other embodiments, LED diode elements of LED array 1000 may be disposed in any configuration on top of inner liner 130.

In one embodiment, LED array 1000 may be aligned with viewing window 150 on outer shell 110. With this arrangement, the individual LED diode elements of LED array 1000 may be visible to a wearer of article 100 from within the interior of outer shell 110. As described above, LED array 1000 may be used to communicate the status of a heating system disposed within the interior of article 100 to a wearer. In some embodiments, one or more individual LED diode elements may be configured to light up in response to a setting associated with heating system 400 and/or a temperature associated with the interior of inner liner 130.

In an exemplary embodiment, a setting of heating system 400 may be communicated to a wearer by the frequency or sequence of the illumination of individual LED diode elements of LED array 1000. For example, when heating system 400 is in an off state, none of the LED diode elements of LED array 1000 may be illuminated. Once heating system 400 is turned to an on state, one or more of the LED diode elements of LED array 1000 may be illuminated in a predetermined order. In this embodiment, first LED diode 1002, second LED diode 1004, third LED diode 1006, fourth LED diode 1008, and fifth LED diode 1010 may be illuminated in a predetermined order to communicate to the wearer that heating system 400 is an on state.

In an exemplary embodiment, the predetermined order of illumination may correspond to a sequence of illumination of specific individual LED diode elements over a predetermined period of time. In this embodiment, first LED diode 1002 may be illuminated at a first time 1012, followed by illumination of second LED diode 1004 at a second time 1014. Continuing in the predetermined order, third LED diode 1006 may be illuminated at a third time 1016, fourth LED diode 1008 may be illuminated at a fourth time 1018, and fifth LED diode 1010 may be illuminated at a fifth time 1020.

In one embodiment, the predetermined order of illumination may be associated with a frequency of illumination of individual LED diode elements over a predetermined period of time. In some cases, the frequency of illumination of the LED diode elements may be increased or decreased to indicate a high power or low power setting of heating system 400. With this arrangement, the amount of time each LED diode element remains illuminated at each of first time 1012, second time 1014, third time 1016, fourth time 1018, and/or fifth time 1020, described above, may be changed to increase or decrease the frequency of the sequence of illumination of LED array 1000 in correspondence to the setting of heating system 400. For example, when heating system 400 is set to a high power setting, the sequence of illumination of LED diode elements in LED array 1000 may be associated with a higher frequency such that each of first LED diode 1002, second LED diode 1004, third LED diode 1006, fourth LED diode 1008, and fifth LED diode 1010 cycle through a period of illumination in a shorter amount of time than when heating system 400 is set to a low power setting.

In another embodiment, a number of individual LED diode elements of LED array 1000 may be varied based on the setting or temperature. For example, a single LED diode element may be illuminated when heating system 400 is set to a low power setting and all of the LED diode elements of LED array 1000 may be illuminated when heating system 400 is set to a high power setting. Similarly, an intermediate number of LED diode elements may be illuminated when heating system 400 is set to an intermediate or medium power setting.

In addition, it should be understood that other configurations and combinations of illuminating LED diode elements of LED array 1000 to communicate information to a wearer may be provided.

Figure 11:
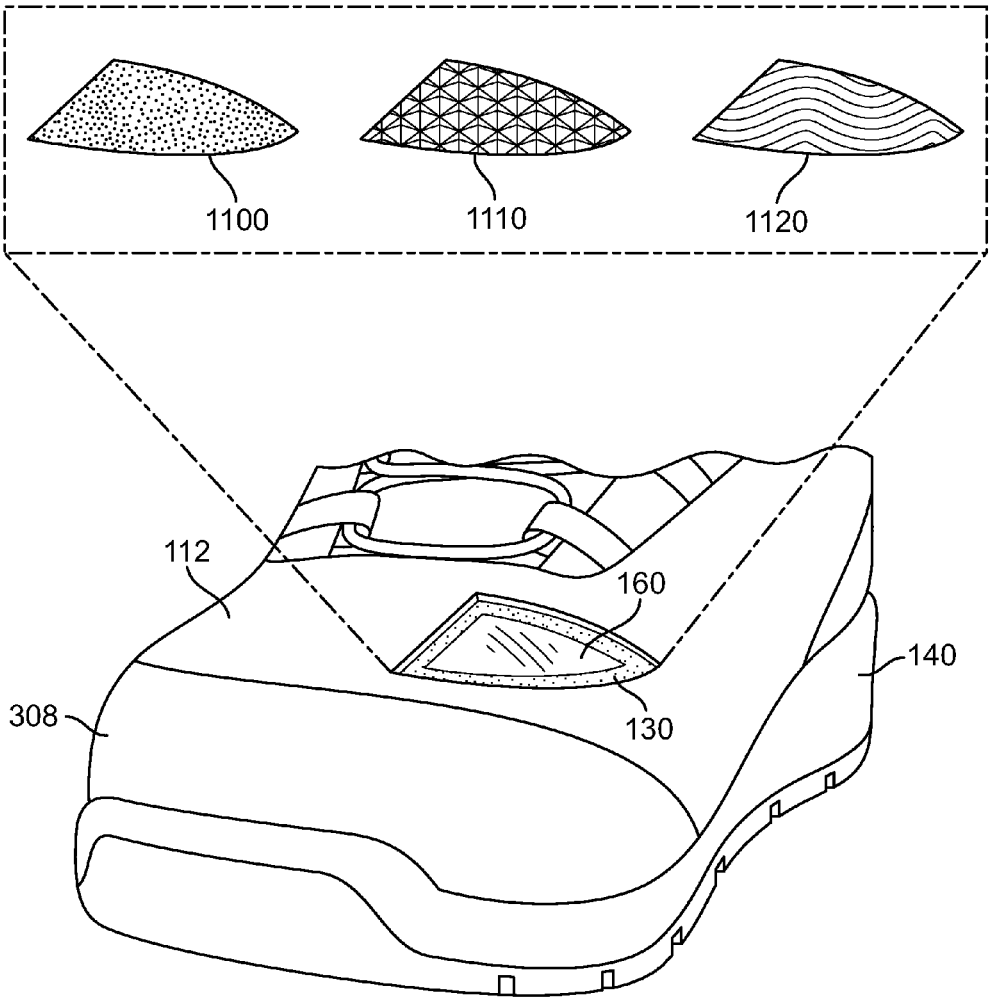
FIG. 11 is an enlarged view of alternate embodiments of viewing windows for an indicator arrangement disposed on a forefoot region of an article of footwear.

In some embodiments, the viewing window disposed on outer shell 110 of article of footwear 100 may be made of a material that at least partially obscures the view within the interior of outer shell 110. For example, a viewing window may be made of a non-transparent material that is configured to partially block or obscure the view of inner liner 130 and/or indicator 160 when in a non-illuminated condition within outer shell 110. Referring now to FIG. 11, alternate embodiments of viewing windows for outer shell 110 that may be used to at least partially obscure or block the view within the interior of outer shell 110 is illustrated.

FIG. 11 illustrates a plurality of alternate embodiments of viewing windows. In this embodiment, each viewing window may be substantially similar in size and shape to viewing window 150, described above. In FIG. 11, however, the alternate embodiments of viewing windows may be configured to only permit light from indicator 160 to pass through when indicator 160 is an illuminated condition. In one embodiment, a smoked viewing window 1100 may be made from a tinted or colored piece of plastic or other suitable material that does not permit a view of the interior of outer shell 110 to view inner liner 130 and/or indicator 160 when in a non-illuminated condition. However, smoked viewing window 1100 may be sufficiently translucent so that upon illumination of indicator 160, the light from indicator 160 may pass through smoked viewing window 1100 to be visible to a wearer from the outside of outer shell 110.

Similarly, a prismatic viewing window 1110 may also be provided as an alternate embodiment of a viewing window. Prismatic viewing window 1110 may be made from a prismatic pattern sheet of film or plastic that is configured to reflect and/or refract light from within the interior of outer shell 110. However, because of the prismatic pattern of prismatic viewing window 1110, the view within the interior of outer shell 110 may be at least partially obscured. Upon illumination of indicator 160, the light from indicator 160 may be reflected and/or refracted to be visible to a wearer from the outside of outer shell 110.

In another alternate embodiment, a holographic viewing window 1120 may be provided. Holographic viewing window 1120 may be a holographic sheet or film that is provided with a pattern disposed on the outside. The holographic sheet or film may have the pattern disposed on the outside using a laser through known holographic processes. With this arrangement, when indicator 160 is in the non-illuminated condition, holographic viewing window 1120 at least partially obscures or blocks the view within the interior of outer shell 110. However, holographic viewing window 1120 may be sufficiently translucent so that upon illumination of indicator 160, the light from indicator 160 may pass through holographic viewing window 1120 to be visible to a wearer from the outside of outer shell 110. With this arrangement, the embodiments of viewing windows illustrated in FIG. 11, including smoked viewing window 1100, prismatic viewing window 1110, and/or holographic viewing window 1120, may be used to at least partially obscure or block the view within the interior of outer shell 110, yet allow light from indicator 160 in the illuminated condition to pass through to be visible to a wearer.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an outer shell, the outer shell including an upper and a sole structure;

an inner liner, the inner liner being a separate component designed to be inserted and also removed from within an interior of the outer shell;

the inner liner further comprising a heating system, the heating system including a control device, a power source and at least one heating element;

wherein the heating system is disposed within the inner liner;

wherein the control device is disposed adjacent a top edge of a cuff of the inner liner;

the inner liner having an upper liner portion and a lower liner portion, wherein the lower liner portion includes an indicator disposed along a top of a forefoot region of the inner liner;

wherein the indicator is in electrical communication with the heating system, the indicator being configured to indicate a status condition of the heating system; and wherein the outer shell further comprises a viewing window disposed on a top portion of the upper, the viewing window being substantially aligned over the indicator disposed on the inner liner.

2. The article of footwear according to claim 1, wherein the indicator is configured to be switched between a non-illuminated condition and an illuminated condition.

3. The article of footwear according to claim 2, wherein the non-illuminated condition of the indicator is associated with an off state of the heating system and the illuminated condition of the indicator is associated with an on state of the heating system.

4. The article of footwear according to claim 2, wherein the non-illuminated condition of the indicator and the illuminated condition of the indicator are visible through the viewing window when the inner liner is inserted within the outer shell.

5. The article of footwear according to claim 1, wherein the viewing window comprises a non-transparent material.

6. The article of footwear according to claim 5, wherein the viewing window is secured within a cut-out portion in the top portion of the upper of the outer shell.

7. An article of footwear comprising:

an outer shell, the outer shell including an upper and a sole structure;

an inner liner, the inner liner being a separate component designed to be inserted and also removed from within an interior of the outer shell;

the inner liner further comprising a heating system, the heating system including a power source, a control mechanism, and at least one heating element;

wherein the heating system is disposed within the inner liner;

the inner liner having an upper liner portion and a lower liner portion;

wherein the control mechanism is disposed along a top edge of a lateral side of the upper liner portion;

the lower liner portion including a bottom disposed along an underside of the inner liner, the bottom being configured to rest along a bottom of the interior of the outer shell when the inner liner is inserted within the outer shell;

the lower liner portion further comprising a top forefoot portion disposed along a top of the inner liner in a forefoot region and an indicator disposed on the top forefoot portion of the inner liner;

wherein the indicator is electrically connected to the heating system; and wherein the indicator is visible from within the interior of the outer shell through a viewing window disposed on a top portion of the upper in the forefoot region of the outer shell.

8. The article of footwear according to claim 7, wherein the heating system and the indicator are integrated entirely within the inner liner.

9. The article of footwear according to claim 7, wherein the location of the indicator on the inner liner corresponds to the location of the viewing window on the outer shell.

10. The article of footwear according to claim 7, wherein the indicator is configured to communicate a status condition associated with the at least one heating element.

11. The article of footwear according to claim 10, wherein the control mechanism is configured to switch the indicator between a non-illuminated condition and an illuminated condition.

12. The article of footwear according to claim 11, wherein the non-illuminated condition of the indicator is associated with an off state of the at least one heating element and the illuminated condition of the indicator is associated with an on state of the at least one heating element.

13. The article of footwear according to claim 7, wherein the indicator includes a first indicator associated with a first power level of the at least one heating element and a second indicator associated with a second power level of the at least one heating element.

14. An article of footwear comprising:

an outer shell and an inner liner, the inner liner including an integrated heating system;

the inner liner being a separate component designed to be inserted and also removed from within an interior of the outer shell;

the integrated heating system including a control mechanism, a power source, and a heating element;

wherein the integrated heating system is disposed within the inner liner;

wherein the control mechanism is disposed along a top edge of a lateral side of the inner liner and the control mechanism is accessible from the outer shell;

the inner liner having an upper liner portion and a lower liner portion, wherein the lower liner portion includes an indicator disposed along a top of a forefoot region of the inner liner;

wherein the indicator is electrically connected to at least one of the control mechanism and the heating element, the indicator being configured to indicate a status condition of the heating system;

wherein the indicator is configured to be in a non-illuminated condition when the integrated heating system is in a first state and wherein the indicator is configured to be in an illuminated condition when the integrated heating system is in a second state; and wherein outer shell further comprises a viewing window disposed on a top portion of an upper, the viewing window being substantially aligned over the indicator disposed on the inner liner.

15. The article of footwear according to claim 14, wherein the non-illuminated condition of the indicator and the illuminated condition of the indicator are visible through the viewing window when the inner liner is inserted within the outer shell.

16. The article of footwear according to claim 14, wherein the indicator includes at least one lighting device.

17. The article of footwear according to claim 16, wherein the lighting device includes at least one light emitting diode.

18. The article of footwear according to claim 15, wherein the indicator is disposed towards a medial side of the top of the forefoot region of the inner liner; and wherein the viewing window is disposed towards the medial side on the top portion of the upper.

19. The article of footwear according to claim 14, wherein the viewing window comprises a non-transparent material secured within a cut-out portion in the top portion of the upper of the outer shell.

* * * * *